US007788859B2

(12) United States Patent
Trotter

(10) Patent No.: US 7,788,859 B2
(45) Date of Patent: Sep. 7, 2010

(54) SYSTEMS AND METHODS FOR REPAIRING WALLS

(76) Inventor: William Clay Trotter, 2614 Chestnut Dr. North, Doraville, GA (US) 30360

( * ) Notice: Subject to any disclaimer, the term of this patent is extended or adjusted under 35 U.S.C. 154(b) by 344 days.

(21) Appl. No.: 11/858,568

(22) Filed: Sep. 20, 2007

(65) Prior Publication Data

US 2009/0078843 A1 Mar. 26, 2009

(51) Int. Cl.
*E04G 21/26* (2006.01)

(52) U.S. Cl. ..... 52/127.2; 52/149

(58) Field of Classification Search ..... 52/146, 52/149, 150, 151, 126.3, 127.1, 152, DIG. 1; 248/121

See application file for complete search history.

(56) References Cited

U.S. PATENT DOCUMENTS 978,740 A * 12/1910 Hamilton et al. ..... 52/151
3,798,856 A * 3/1974 Gloskowski ..... 52/127.2
4,068,427 A * 1/1978 Camardo ..... 52/127.2
4,070,833 A * 1/1978 Hancock ..... 52/148
4,078,633 A * 3/1978 Fahy ..... 182/82
4,083,156 A * 4/1978 Tye ..... 248/354.5
4,872,634 A * 10/1989 Gillaspy et al. ..... 248/354.3
5,481,836 A * 1/1996 Miller et al. ..... 52/127.2
6,112,475 A * 9/2000 Truitt ..... 52/127.2
6,782,668 B2 * 8/2004 Bruce ..... 52/147
7,380,372 B2 * 6/2008 Resch et al. ..... 52/127.2

* cited by examiner

*Primary Examiner*—Richard E Chilcot, Jr.
*Assistant Examiner*—Chi Nguyen
(74) *Attorney, Agent, or Firm*—Troutman Sanders LLP; James Hunt Yancey, Jr.; Robert R. Elliot, Jr.

(57) ABSTRACT

Systems and methods for repairing walls are provided used to repair foundational and veneer walls that have bowed or shifted. A system can include a wall support member disposed proximate a wall; an anchor disposed below the wall support member (the anchor can be affixed to a bottom portion or component of the wall (e.g., a foundational pier)); a tension member (e.g., a chain) affixed to the anchor and the wall support member; a brace affixed to the wall support member at a first end; and a stake in operable communication with a second end of the brace operable to prevent movement of the second end of the brace. Increasing tension on the tension member between the anchor and the wall support member (with a jack, for example) causes the wall to be shifted (e.g., horizontally and vertically) for repositioning the settled wall. The wall can then be re-anchored and re-attached to the structure to aid in preventing future movement of the wall. Other embodiments are also claimed and described.

17 Claims, 6 Drawing Sheets

SYSTEMS AND METHODS FOR REPAIRING WALLS

TECHNICAL FIELD

The various embodiments of the present invention relate generally to repairing walls and more particularly to systems and methods for repairing walls (e.g., foundational and veneer) that have bowed, cracked, shifted, or rotated. Also embodiments of the present invention are directed to systems and methods for repairing walls incurring ground settlement or shifting, built with improper or poor construction techniques, or having diminished or failed materials.

BACKGROUND

Many structures are built directly on the ground. This means that the interface between structures and the ground is important for building structural concerns. Typically, the ground's surface is made up of clays, such as bentonite, or other unstable soils that may shift or settle over time. In addition, ground surfaces can heave or sink when subjected to various environmental weather states, such as heavy rainfall, freezing and thawing temperatures, etc.

Movement of ground surfaces can drastically affect the interface between the ground and the structure. For example, ground heaving and sinking can cause the foundation of structures (e.g., houses, buildings, etc.) to move, shift, or weaken. This, in turn, can cause severe damage to the foundation and structure. It is generally recommended, therefore, that structure foundations be secured in the stable subsurface to help prevent structural damage.

Sometimes, however, properly constructed structures and those not constructed properly do change from their original constructed state for various reasons. When repairing foundations and walls it is usually cost prohibitive to remove unstable soil and replace it or build the foundation directly on the stable subsurface. Instead, piers are generally driven into the stable subsurface and the foundation is attached at various points, depending on the size and weight of the structure and other design considerations, to the piers to stabilize the foundation.

Brick veneers are often used to provide a decorative finish to homes or other structures. One advantage of brick veneers is that they require little or no maintenance after installation. Improper construction or installation techniques, however, may cause the brick veneer to bow or crack. For example, if brick ties are not used or are improperly positioned during installation of brick veneer, then the brick veneer may rotate or separate away from a structure. Also, if settlement occurs the brick veneer may rotate away from the structure thereby separating from the building. Conventional approaches to solving such problems include placing piers under the brick veneer and reconstruction of the brick veneer. These solutions, while serving their respective purposes, are complex, costly, and time consuming.

What is needed, therefore, are new methods and systems for repairing damage to brick veneers and foundational walls. It is to the provision of such systems and methods for repairing settled walls that the various embodiments of the present invention are directed. Indeed, embodiments of the present invention can be used for repairing walls incurring ground settlement or shifting, built with improper or poor construction techniques, or having diminished or failed materials.

BRIEF SUMMARY

Briefly described, embodiments of the present invention provide systems and methods for repairing walls. One system embodiment can include a wall support member disposed proximate a wall; an anchor disposed below the wall support member, the anchor affixed to a foundational pier; a chain affixed to anchor at a first end and a to the wall anchor; a brace affixed to the wall support member at a first end; and a stake in operable communication with a second end of the brace operable to prevent horizontal movement of the second end of the brace. Increasing tension on the chain between the anchor and the wall support member causes the wall to be shifted horizontally thereby repairing the wall.

A method embodiment can include various steps. For example, a method can include affixing an anchor to a foundational pier below a wall; positioning a stake corresponding to the anchor away from the wall; placing a brace between the stake and the wall such that a first end of the stake is in operable communication with the stake and the second end of the brace is in operable communication with the wall; affixing a chain to the anchor; connecting the chain to the second end of the brace; and increasing a tension on the chain between the brace and the anchor. Increasing tension on the chain between the anchor and the wall support member causes the wall to be shifted horizontally to repair the wall and preserve appearance of the brick veneer.

Another system embodiment of the present invention can generally comprise a wall support member, a tension member, and an elongated brace. The wall support member can be disposed proximate a wall and situated to direct a force on the wall. The tension member can exert a downward force on the wall support member such that the wall support member tends to move down the wall. The elongated brace can have two ends. A first end can be affixed to the wall support member, and the second end can be fixed at a point. By having its send end affixed at a point, the brace can direct a force toward the wall support member to move the wall.

The system can also include additional features. For example, the system can further comprise an anchor. The anchor can be disposed below the wall support member, and connected to a portion of the wall below the wall support member and the tension member. The anchor can also comprise an attachment portion so that the anchor can be affixed to a foundational pier associated with the wall. As another example, the system can further comprise a stake. The stake can hold the elongated brace at the fixed point. Also, the brace can be in operable communication with the second end of the brace to prevent movement of the second end of the brace. Prevention of movement of the brace's second advantageously redirects force to the wall for movement of the wall. In some embodiments, the brace can have multiple telescoping members adapted to move relative to each other, and in others, the brace can be a one piece integral component having rigid properties or allowed to bend and flex.

A system embodiment of the present invention can also include additional features. For example, the system can include a pivotal coupler to couple the first end of the brace and the wall support member. The pivotal coupler advantageously enables the first end of the brace to pivot relative to the wall support member so that the wall support member can move along the wall. While the wall support members can have many shapes and sizes for various surface areas, the wall support member can have a surface area ranging from approximately one square fee to approximately three square feet. In addition, the tension member of a system embodiment can comprise one or more materials including a chain, nylon strap, screw, and tension rod. A system embodiment can also comprise a tension component (e.g., a jack) connected to the tension member. The tension component is preferably adapted to decrease the length of the tension member to vary a downward force applied to the wall support member for wall movement. A system embodiment can also comprise another jacking device. The jacking device can be connected to the brace to provide a force along the brace. This force can direct a horizontal force toward the wall support member to move the wall.

Other method embodiments are also contemplated by the present invention. For example, another method to repair a wall generally comprises providing a wall support member proximate a wall to be in contact with the wall; applying a substantially downward vertical force on the wall support member; and redirecting the vertical force to the wall support member. Redirection of the force enables directed the force toward the wall in a substantially horizontal direction such that horizontal force moves the wall. The wall support member can be pivotally affixed to the first end of the brace, and the wall support member can have a surface area ranging from about one square foot to about three square feet. The method may also include affixing an anchor proximate a foundational pier, coupling the anchor to the wall support member, and causing the wall support member to move closer to the anchor such that the anchor exerts the substantially downward vertical force on the wall support member.

Method embodiments of the present invention may also include additional features. For example, the method can include pivotally coupling a brace to the wall support member at a first end of the brace and affixing a second end of the brace to a fixed point. Such an arrangement advantageously enables the brace to direct the vertical force horizontally toward the wall. Additionally, the method can include fixing the second end of the brace at the fixed point with a stake. A staking arrangement fixes the brace to prevent the brake from moving in a horizontal direction away from the wall. A method may also include affixing an anchor proximate a foundational pier, coupling the anchor to the wall support member, and causing the wall support member to move closer to the anchor such that the anchor exerts the substantially downward vertical force on the wall support member.

In still yet other embodiments, the present invention can be configured as a system to repair a damaged wall by providing a horizontal force toward the wall. Such a system can include an apparatus configured to redirect a vertical force to provide the horizontal force. The apparatus can generally comprise a force application brace and an anchor. The force application brace can have a first end and a second end. The first end can be directed toward a damaged wall and the second end can be fixed. Fixing the second end prevents the second end can from moving horizontally away from the damaged wall. The anchor can be disposed below the first end of the brace and underneath at least a portion of the damaged wall. The anchor and the first end of the brace can be coupled together with a tension member. The tension member can be configured to draw the first end of the brace closer to the anchor such that the distance between the first end of the brace and the anchor is decreased by application of a downward vertical force at the first end of the brace. Such an arrangement advantageously enables the second end of the force application brace to receive the downward vertical force and redirect the vertical force in a horizontal manner and apply the horizontal force toward the damaged wall. Application of the force toward the wall can be used to re-position a damaged wall.

System embodiments of the present invention may also include additional features. For example, a system can include an apparatus further comprising a wall support member disposed between and pivotally coupled to a first end of the brace and a damaged wall. The wall support member is preferably configured to distribute a horizontal force transferred to the wall. In addition, an apparatus can include a crank device coupled between the tension member and the first end of the brace. The crank device is preferably configured to reduce the length of the tension member. Also, an apparatus can include a jack associated with the force application brace. The jack can be configured to adjust the length of the force application brace to direct a horizontal force toward a damaged wall to re-position a damaged wall.

Other aspects and features of embodiments of the present invention will become apparent to those of ordinary skill in the art, upon reviewing the following description of specific, exemplary embodiments of the present invention in conjunction with the accompanying figures.

BRIEF DESCRIPTION OF DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings.

Figure 1:
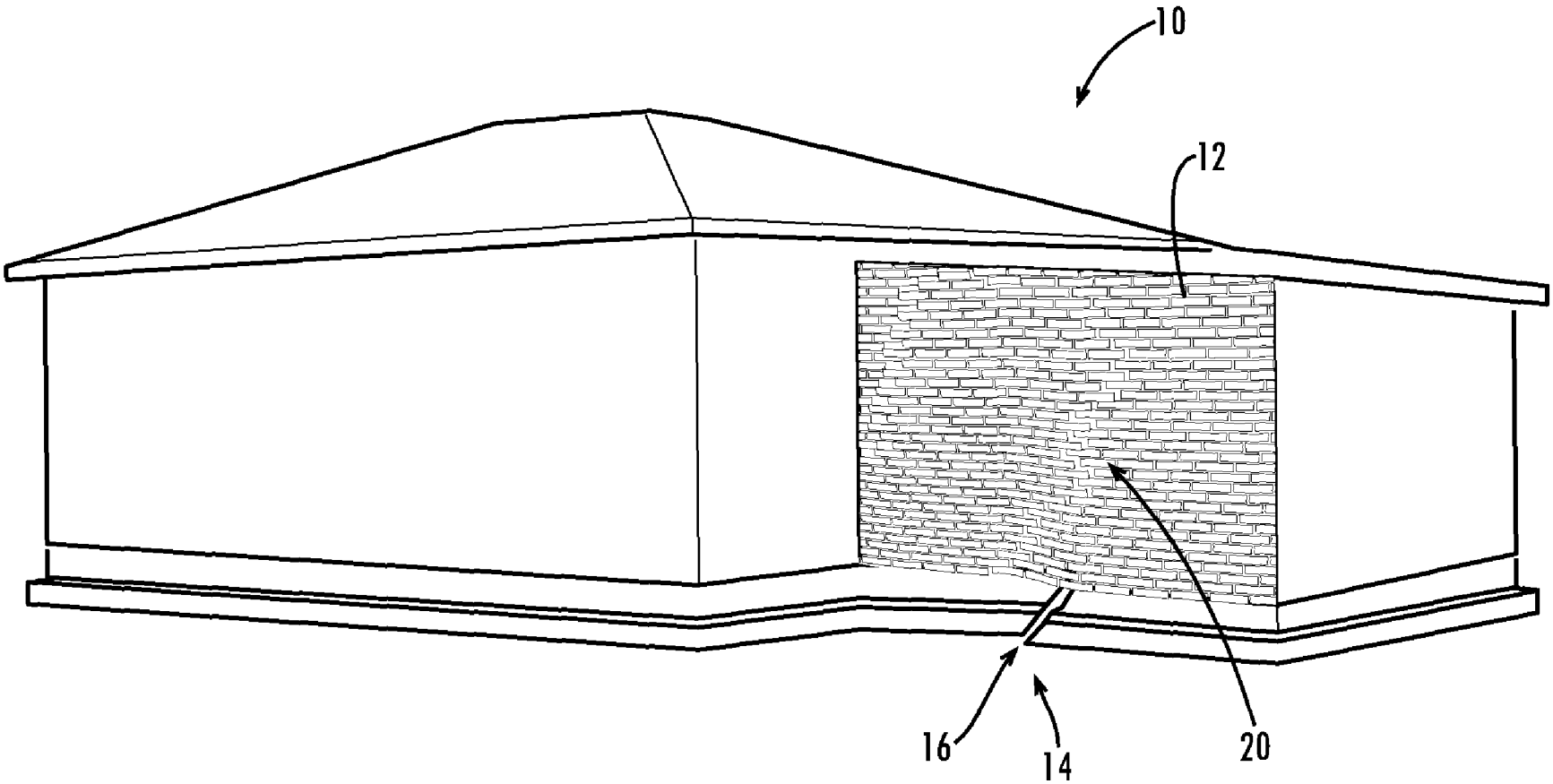
FIG. 1 is a perspective view of a structure with a damaged wall that illustrates a disfiguration of the wall's brick veneer.

The below description explains preferred and alternative embodiments of the invention, together with advantages and features, by way of example with reference to the drawings.

DETAILED DESCRIPTION OF PREFERRED & ALTERNATIVE EMBODIMENTS

Referring now to the figures, wherein like reference numerals represent like parts throughout the several views, exemplary embodiments of the present invention will be described in detail. Throughout this description, various components may be identified having specific values or parameters, however, these items are provided as exemplary embodiments. Indeed, the exemplary embodiments do not limit the various aspects and concepts of the present invention as many comparable parameters, sizes, ranges, and/or values may be implemented.

FIG. 1 is a perspective view of a structure with a damaged wall that illustrates a disfiguration of the wall's brick veneer. As shown, a structure 10 includes a side wall 12 that has been damaged. The damage 14 includes a crack in the foundation 16 and movement of a brick veneer 20 away from the structure. Typically, the end result of such damage is that the brick veneer 20 rotates away from the structure thereby causing the brick veneer to bow out from the structure 10. The damage may be possibly caused by one or more of ground settlement that causes foundation shifting, improper or poor construction techniques, or the lack of or broken brick ties.

As mentioned above, conventional repair methods have certain drawbacks. For example, conventional repair methods include lifting a settled foundation 16 and placing a new support pier below the settled area of the side wall 12. This solution does not enable simultaneous correction of the damaged brick veneer 20. In other words, conventional methods of moving the settled foundation in a vertical direction (to account for foundation shifting) does not also rotate the brick veneer 20 back into place. Also, using conventional systems and methods to move the foundation 16 back in place may result in the brick veneer 20 being further rotated away from the structure 10 or in the brick veneer 20 completely separating from the structure 10.

Figure 2:
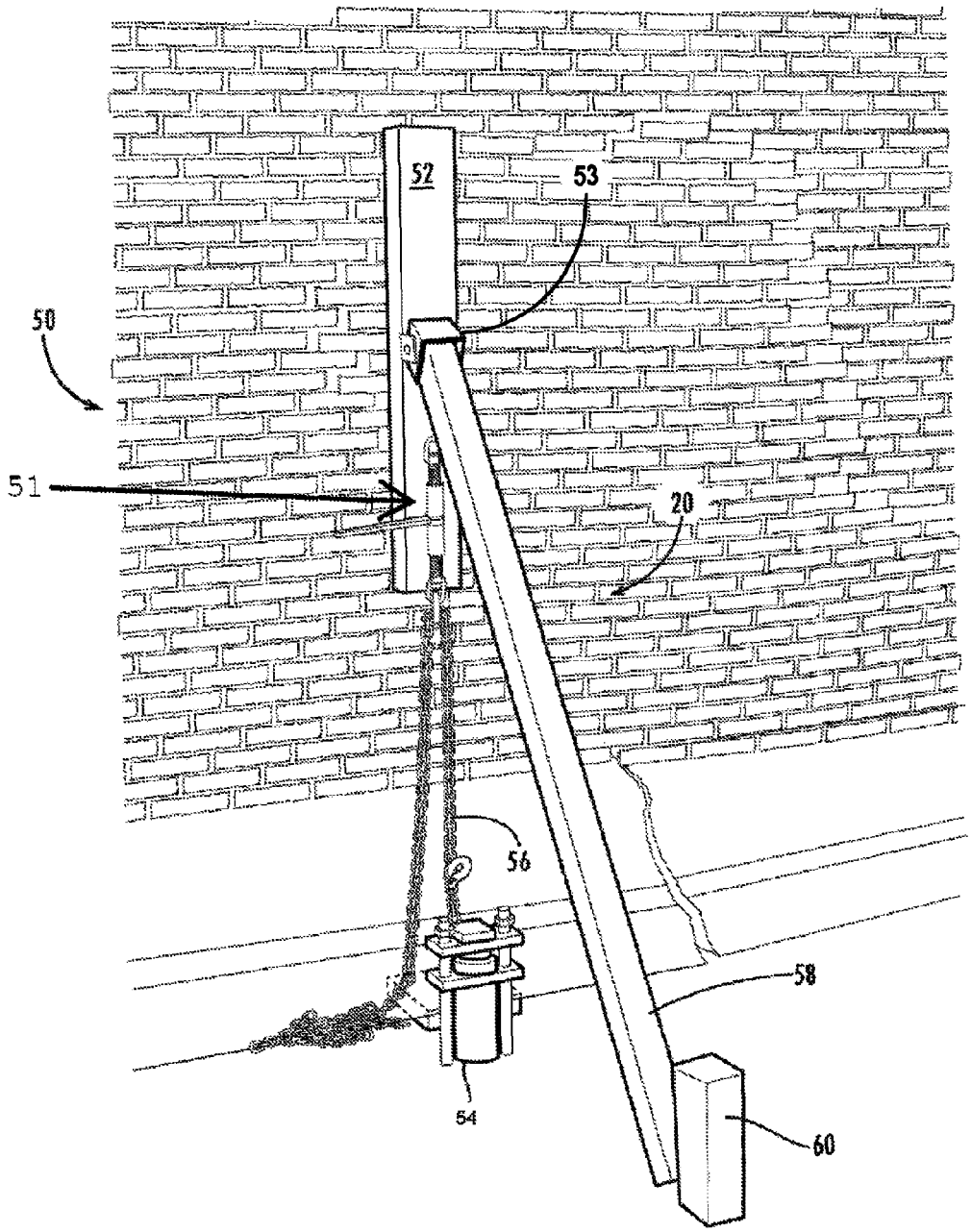
FIG. 2 is a perspective view of a system for repairing a damaged wall according to some embodiments of the present invention.

The present invention is directed to embodiments that enable both vertical and horizontal movements of a damaged wall. As an example, FIG. 2 is a perspective view of a system 50 for repairing a damaged wall according to some embodiments of the present invention. As shown, the wall support system 50 can be used to correct damage to the brick veneer 20 as well as other damaged foundational or structural walls.

The wall support system 50 generally includes a wall support member 52 disposed on the brick veneer 20 (or another wall type). The support member 52 can be a piece of lumber or a sheet of metal. Alternatively, the support member 52 may be any material capable of contact with the wall 12 to distribute a force to the wall 12. Preferably, the support member 52 is constructed from a rigid material, such as wood, plastic, metal, or the like. The wall support member 52 is used to apply a force to the wall and thus preferably has a surface area capable of evenly distributing the force to the wall in such a manner as to not damage the wall. Indeed, in certain embodiments, the surface area of the wall support member 52 can range from approximately one to approximately three square feet as such contact area advantageously enables adequate force transfer on the wall 12. Also, in certain embodiments, the wall support member 52 may be adhered, bonded, or coupled to the wall 12 to ensure adequate contact between the wall 12 and wall support member 52.

The wall support system 50 also includes an anchor 54 disposed below the wall support member 52. In exemplary embodiments, the anchor 54 can be affixed to a foundational pier or to the foundation of the structure 10. As shown, the anchor 54 is placed beneath the wall 12 such that it can apply a force to the wall. The anchor 54 may also include internal jacking or lifting components to aid in providing a force. The anchor 54 shown in FIG. 2 is for illustrative purposes, and in other embodiments, an anchor can be configured to attach to a foundation, pier, or perhaps to the outer surface of the wall. Indeed, the exact arrangement and configuration of an anchor can vary as desired. What is important is that an anchor be configured such that it enables attachment or coupling to a wall 12 (or associated foundation) so that the anchor can aid in wall movement by transferring a force to the wall. Thus, the anchor preferably provides a connection point at which the wall support system 50 can be disposed to move the damaged wall for repair. Those of skill in the art will understand the various anchor configurations so known anchor details are not discussed herein.

The wall support system 50 also preferably includes a tension member 56. As shown, the tension member 56 can be a chain 56 that is affixed to the anchor 54 and the wall support system 52. In other embodiments, other components capable of being tensioned and supporting a load can be used in the place of the chain 56. For example, nylon straps, ropes, screws, and tension rods may be utilized. In addition, more than one tension member 56 may also be used. The exact type of material and make up of the tension member 56 is not specifically required to be a certain type of material although in certain applications it may be desired to use a certain type of material. What is important is that the tension member 56 be capable of supporting a load to enable movement and repositioning of a wall, such as a brick veneer wall.

The wall support system 50 can also include a brace 58. The brace 58 can be coupled to the wall support member 52 at a first end of the brace 58. The brace may be constructed of wood, metal, plastic, rigid composite, or another suitably durable material. For example, the brace 58 can be a rigid piece of lumber, such as a four by four (4×4). The brace 58 can have a constant length and is preferably capable of withstanding a compression axial force. In other embodiments, the brace 58 can be telescopic to have two or more movable parts capable of movement relative to each other. In such a configuration, the brace 58 may comprise an internal jack (e.g., a hydraulic jack) or an internal locking mechanism to control movement of the telescoping members. In yet other embodiments, the brace 58 may be flexible yet rigid as discussed below in more detail.

The brace 58 is an advantageous component of embodiments of the present invention. Indeed, the brace 58 transfers force to a damaged wall 12 to enable repair. To do so, the brace 58 can be pivotally coupled to the wall support member 52. This advantageous configuration enables the brace 58 to rotate relative to the wall support member 52. As such, when a vertical force is applied to the wall support member 52 from the brace 58, the pivotal coupling 53 transfers the vertical force to the brace 58 and enables the brace 58 to rotate relative to the wall support member 52. This configuration thereby enables the wall support member 52 to remain in substantially flush mount arrangement with the damaged wall 12.

Another advantageous component of embodiments of the present invention relates to the positioning of a second end of the brace 58. As shown in FIG. 2, the second end of the brace 58 is in contact with a stake 60 in this exemplary embodiment. Thus, in this embodiment the stake 60 is preferably disposed in operable communication with a second end of the brace 58 such that the stake 60 prevents displacement or movement of the second end of the brace 58. This advantageous configuration prevents horizontal or vertical movement of the second end of the brace 58 when a force is applied at the first end of the brace 58. This enables the stake 60 to redirect a horizontal force that would usually move the second end of the brace 58 away from the wall 12 by transferring and redirecting the horizontal force toward the wall 12. This force transfer redirecting feature of the present invention advantageously enables horizontal movement of the wall 12 to repair the wall 12.

In other embodiments, the second end of the brace 58 can be disposed or positioned in other arrangements that do not utilize the stake 60. For example, the second end of the brace 58 may be coupled to a jack (e.g., a hydraulic jack). The jack may be firmly positioned so that the second end of the brace 58 is fixed. By coupling the second end of the brace 58 to a jack, the jack can be used exert a force to the brace 58 to direct a force toward a damaged wall 12 for repair of the wall 12. Another configuration may include placing the second end of the brace 58 below ground in a fixed position such as by concreting the second end. Yet another configuration may include affixing the second end of the brace 58 to at least one of the damaged wall 12, the anchor 54, or another fixed point located between the second end of the brace 58 and the damaged wall 12. These additional arrangements provide additional configurations that may be desired depending upon the exact implementation of the wall support system 50.

After components of the wall support system 50, as illustrated in FIG. 2, are disposed as desired, the wall support system 50 can be used to repair the damaged wall 12. The wall support system 50 functions such that when tension on the chain 56 between the anchor 54 and the wall support member 52 is increased, the brick veneer 20 or wall is shifted horizontally while the anchor 54 exerts a vertical force on its wall or foundation contact position. In other words, as distance of the chain 56 between the anchor 54 and the wall support member 52 decreases, the anchor 54 exerts a downward force on the wall support member 52.

The various embodiments of the present invention can utilize differing approaches to increase tension in the tension member 56 to draw the wall support member 52 and the anchor 54 closer together. As shown in FIG. 2, a tension component 51 is disposed between and coupled to the wall support member 52 and the tension member 56. The illustrated tension component 51 is a type of jack device that enables a user to hand crank the jack device at a controlled rate and to increase tension in the tension member 56. It should be understood that a hand-jack device is not the only device that can be used as the tension component 51. Indeed, the tension component 51 can be many other devices capable of increasing tension in the tension member 56 to provide a force to move the wall support member 52 closer to the anchor 54.

Also, in other alternative embodiments, the tension component 51 can have additional characteristics according to various embodiments of the present invention. For example, the tension component 51 can be placed at varying locations between the wall support member 52 and the anchor 54. As shown, the tension component 51 is placed proximate the wall support member 52 to advantageously enable a user to monitor wall movement while operating the tension component 51 during repair operation. Additionally, the tension component 51 can be adapted to handle and work with various types of tension members 56. For example, the tension component 51 can be adapted to tension a tension member 56 comprising one or more integral components or tension members 56 comprising multiple-joined components. Still yet, the tension component 51 can be manually powered, electrically powered, or incorporate hydraulic power components. Thus, the exact nature of the tension component 51 is not critical; rather, what is important is that the tension component 51 can tension the tension member 56 at a controlled, steady rate in an effort to control wall movement.

By forcing the wall support member 52 downward toward the anchor 54, the brace 58 and the stake 60 exert a horizontal force toward the damaged wall 12. In addition, because the brace 58 is pivotally attached to the wall support member 52, the angle θ between the wall 12 and the brace 58 will increase. The advantageous pivotal connection between the brace 58 and the wall support member 52 enables the brace 58 and the fixed position of the stake 60 to exert a horizontal force toward the wall 12. This horizontal force can be used to rotate or shift the brick veneer 20 back toward the structure 10 so that the brick veneer 20 can be repaired. Such repair may include installing brick ties between the brick veneer 20 and the structure 10 so that the brick veneer 20 is held in place after a repair operation.

Figure 3A:
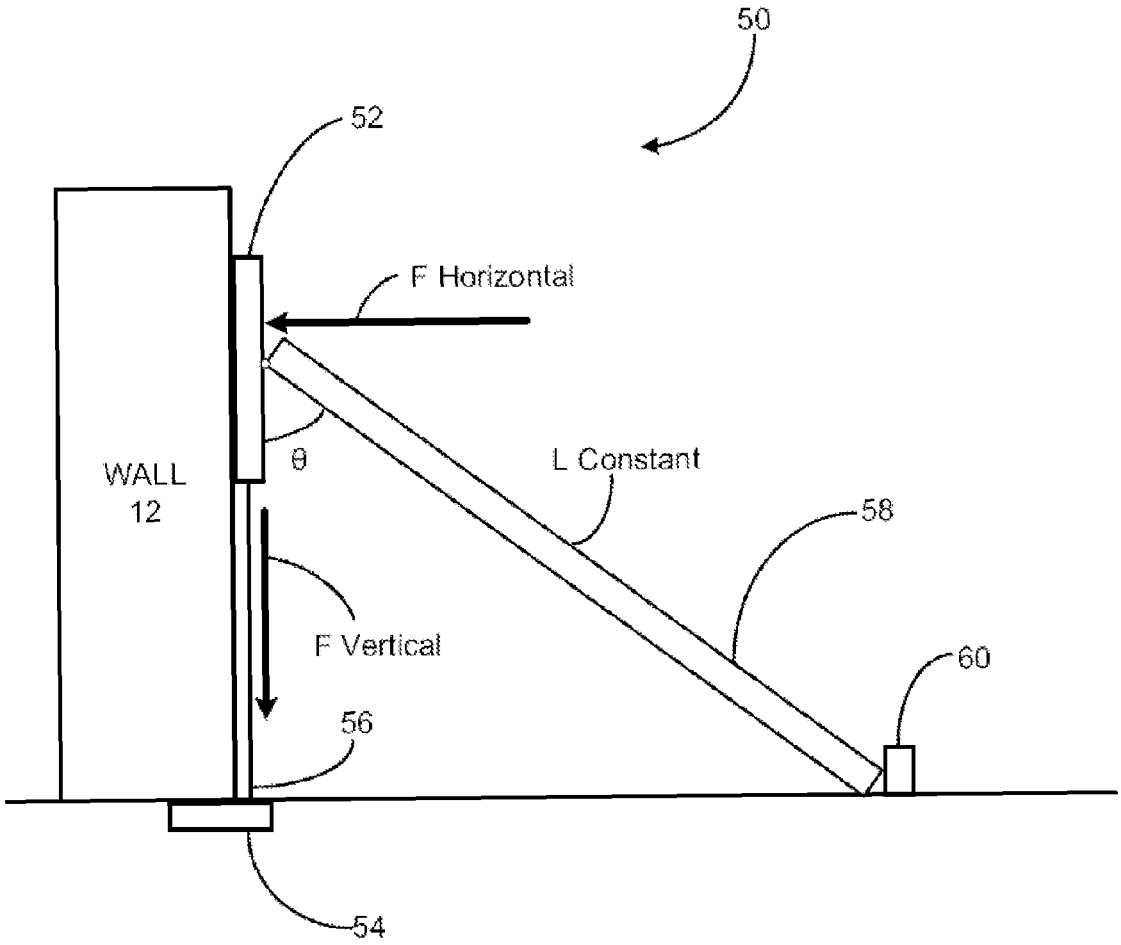
FIG. 3 illustrates a vector force diagram showing vector forces present in the system embodiment of the present invention shown in FIG. 2 for repairing a damaged wall.

To assist in understanding certain advantageous features of the present invention, FIG. 3 illustrates a vector force diagram showing vector forces present in the system embodiment of the present invention shown in FIG. 2 for repairing a damaged wall. As shown, as the length of the tension member (e.g., chain 56) is reduced, the anchor 54 applies a downward vertical force (F Vertical) on the wall support member 52. This vertical force pulls the wall support member 52 toward the anchor 56.

Due to the downward vertical force being applied to the wall support member 52, the downward vertical force is also applied to the brace 58 since it is pivotally attached to the wall support member 52. Because the brace 58 is pivotally attached to the wall support member 52, the second end of the brace 58 attempts to move away from the wall 12. However, because the brace 58 has its second end in a fixed position by the stake 60, and the brace 58 has a constant length (L Constant), the stake 60 exerts a horizontal force (F Horizontal) on the brace 58 toward the wall 12. In other words, the stake 60 redirects the horizontal force (F Horizontal) toward the damaged wall 12 rather than away from the wall 12. Advantageously, as shown by FIG. 3's force vector diagram, the damaged wall 12 of the structure is subjected to a horizontal force such that it is rotated into a repaired position.

Figure 3B:
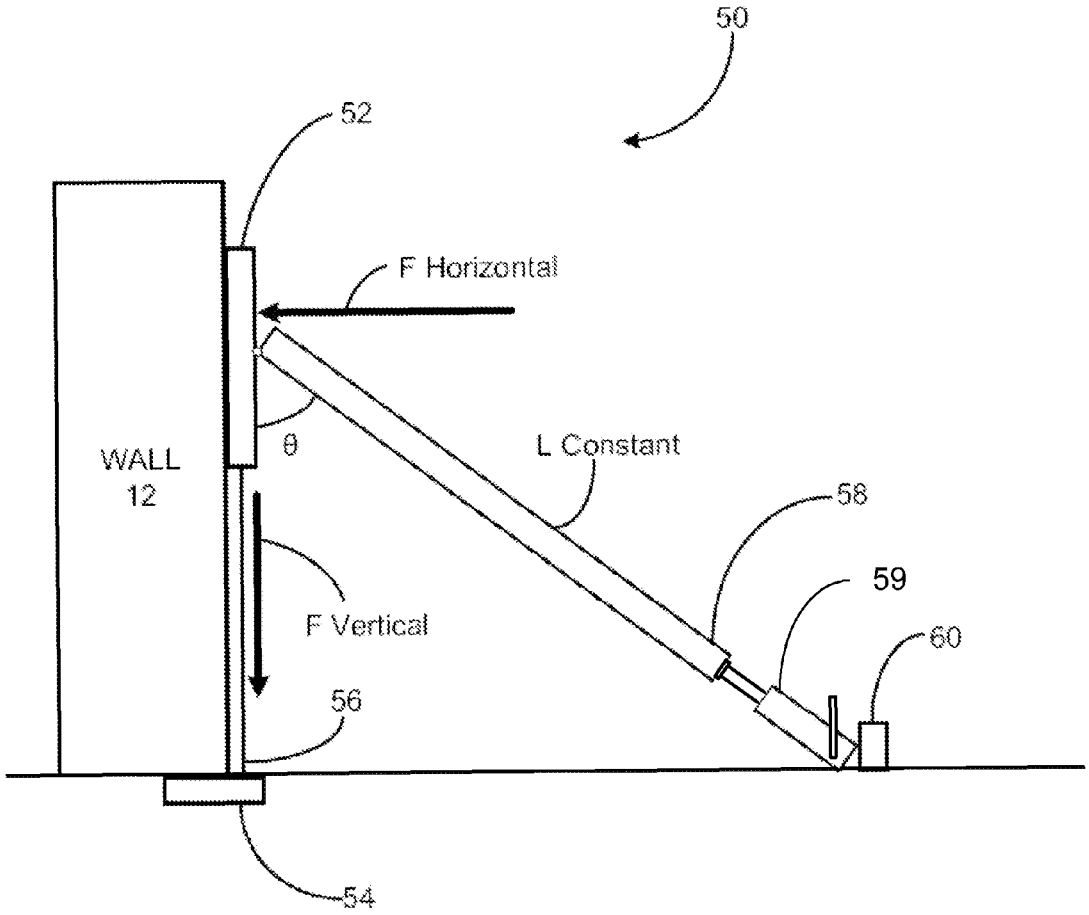

As mentioned above, the second end of the brace 58 can be disposed or positioned in other arrangements that do not utilize the stake 60. In these arrangements, the applied vector forces are similar to those shown in FIG. 3A. For example, in these alternative arrangements, the second end of the brace is affixed at a fixed stationary point thus enabling redirection of a horizontal force toward a damaged wall. The fixed stationary points can include tying the brace 58 to undamaged wall portions of a structure or burying/concreting the second end of the brace in a fixed position. In addition, as shown in FIG. 3B, in those embodiments where a brace includes one or more jacks 59, the jack(s) 59 can provide additional horizontal force toward a damaged wall to aid in repairing the damaged wall. This can be accomplished by a applying a force to make the brace 58 longer so that it extends toward the wall 12. For example, the second end of the brace 58 can be coupled to a jack 59 so that the jack 59 can exert a force along the brace 58 to provide additional horizontal force toward a damaged wall.

As discussed herein, the wall support system 50 can used to fix bowing foundational walls or veneer walls that have separated from a structure 10. The wall support system 50 preferably disposed on the wall to be lifted and rotated, and can exert a horizontal force against the damaged wall in an effort to return the wall to its initial position that it had before being damaged. It should be understood that multiple wall support systems 50 may be used in other embodiments of the present invention. For example, if the settlement occurs in a corner of a structure 10, two or more wall support systems 50, one or more on each side of the corner of the structure 10, may be used to repair the damaged walls or veneers. The wall support system 50 can be used in concert with lifting the settled foundation, such as installing piers below the foundation.

Figure 4:
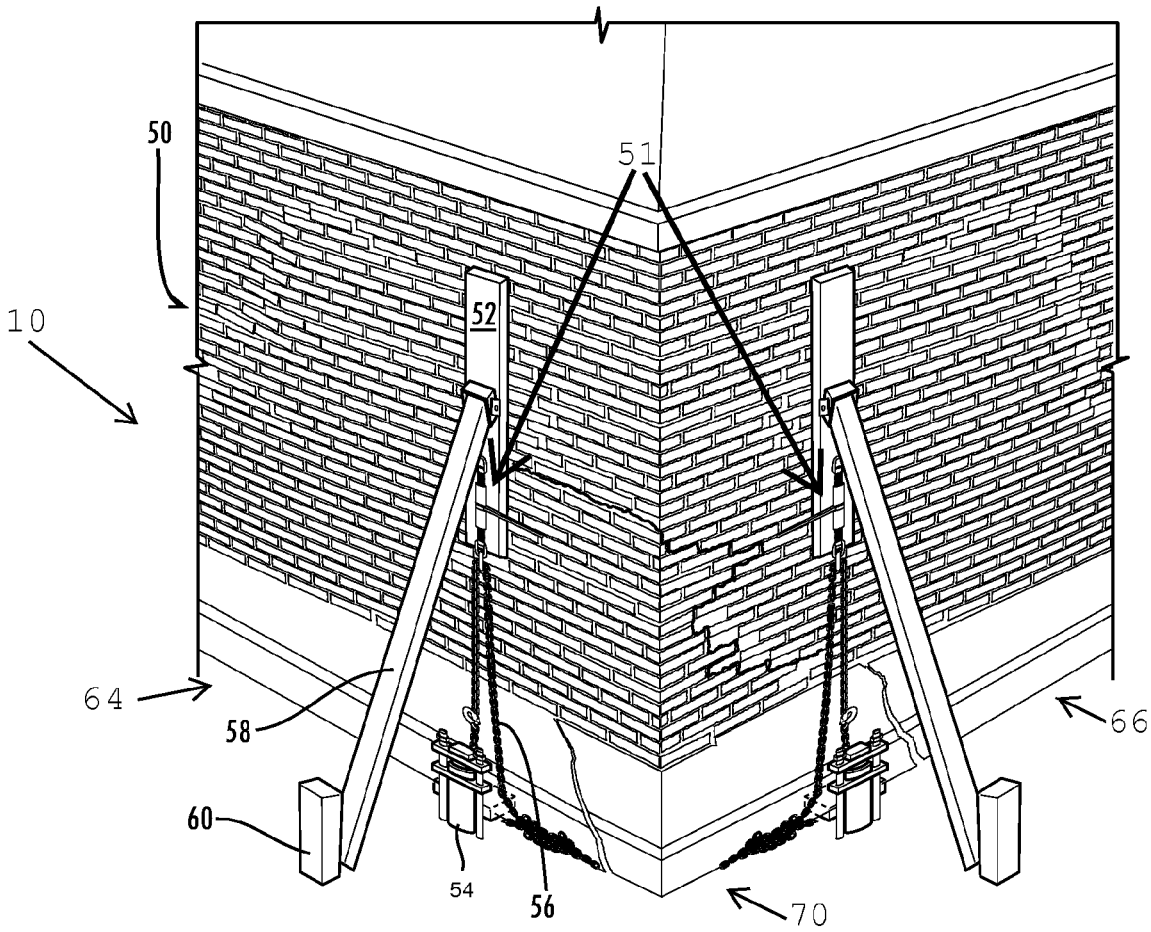
FIG. 4 is another perspective view of another system embodiment for repairing damaged adjacent walls forming a corner of a structure according to some embodiments of the present invention.

FIG. 4 is another perspective view of another system embodiment 400 for repairing damaged adjacent walls 64, 66 forming a corner 70 of a structure 10 according to some embodiments of the present invention. As shown in FIG. 4, multiple wall support systems 50 can be used in concert to repair a damaged corner (consisting of multiple damaged walls). For the structure 10 shown in FIG. 4, it has two adjacent walls 64, 66 that have been damaged resulting in a damaged corner 70. To repair the damaged corner 70, one wall support system 50 can be disposed on wall 64 and another wall support system 50 can be disposed on wall 66. In concert, the two wall support systems 50 can be used to rotate the corner 70 back toward the structure and repair the brick veneer proximate the corner 70.

The wall support systems 50 of FIG. 4 can include the various wall support systems 50 as discussed herein thus for brevity those details are not repeated here. It should be understood that while only two wall support systems 50 are shown in FIG. 4, additional wall support systems can be used as desired. In addition, the wall support systems as discussed herein can also be used to repair chimneys by repairing chimney brick veneer and chimney foundations.

Figure 5:
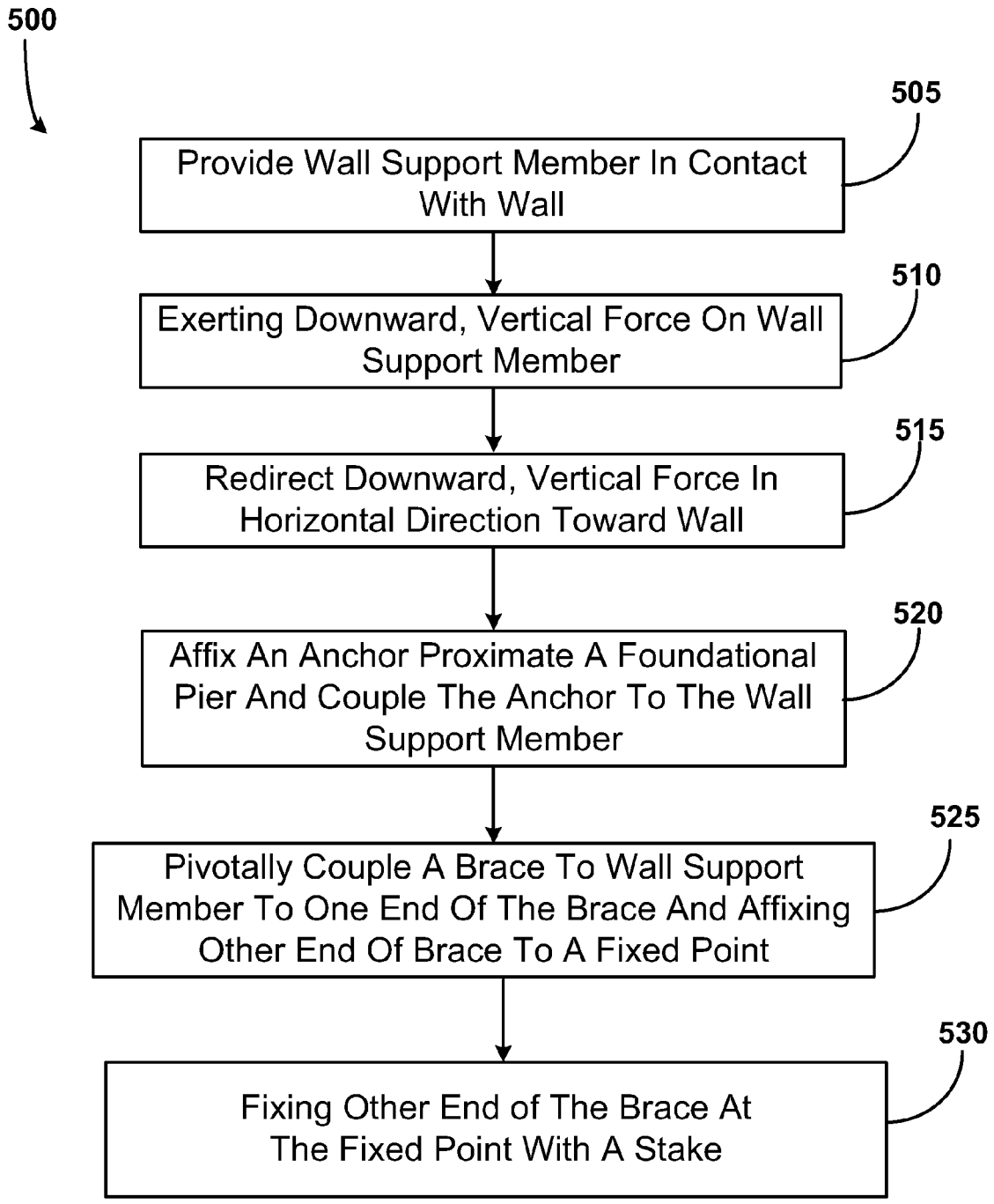
FIG. 5 is a logical flow diagram of a method embodiment for repairing a damaged wall according to some embodiments of the present invention.

FIG. 5 is a logical flow diagram of a method 500 embodiment for repairing a settled wall according to some embodiments of the present invention. It should be understood that the method 500 is only one method embodiment of the present invention and that the method 500 can have various additional features or be performed in various orders. Thus, those skilled in the art will understand that method 500 is discussed for illustrative purposes.

Method 500 can begin by preparing a damaged wall for repair. To do so, a wall support member can be provided proximate the wall. Preferably, the wall support member is positioned to be in flush contact with a wall at 505. The wall support member can be, for example, a piece of 2×4 lumber and is preferably constructed of a material that will not damage the exterior of the damaged wall.

Once the wall support member is in contact with the wall, a substantially downward vertical force can be exerted on the wall support member at 510. This can be down by forcing the wall support member toward the bottom of a wall with a jack and a tension member. Indeed, a jack can be coupled and disposed between the wall support member and an anchor disposed beneath the wall foundation. As mentioned above, the tension member can be a chain, nylon strap, metal tension rod. The jack can be various jack types including a closure-type jack or a come-along type jack.

Then at 515, the downward vertical force can be redirected such that the force is directed toward the wall in a substantially horizontal direction. Preferably, the horizontal force moves the damaged wall into a repaired condition. Redirection of the force can be accomplished by affixing a first end of a brace to the wall support member and a second end of a brace at a fixed point. By disposing the ends of the brace in this fashion, the fixed point holds the second end of the brace in place thereby preventing the brace from moving away from a damage wall and redirecting a horizontal force toward the wall. The redirected horizontal force can be directed toward the damaged wall via the brace to move the damaged wall to a repaired position.

The method 500 can also include additional features. For example, the method 500 can include at 520 affixing an anchor proximate a foundational pier and coupling the anchor to the wall support member with a tension member. Additionally, the method can include causing the wall support member to move closer to the anchor such that the anchor can exert the substantially downward vertical force on the wall support member. This can be accomplished by varying the length of the tension member. As another example, the method at 525 can include pivotally coupling a brace to the wall support member at a first end of the brace and affixing a second end of the brace to a fixed point such that the fixed point causes the brace to direct the vertical force horizontally toward the wall. As yet another example, the method 500 can include fixing at 530 the second end of the brace at the fixed point with a stake such that the stake fixes the brace to prevent the brake from moving in a horizontal direction away from the wall. Preferably the wall support member is pivotally affixed to the first end of the brace. The wall support member can have varying surface areas including ranging from one square foot to three square feet and surface areas greater than three square feet. The inventor has found the one square foot to three square feet configuration advantageous since it evenly distributes the horizontal force toward the damaged wall for normally occurring structural walls. It should be understood, however, that the surface area of the wall support member can vary as desired or upon application (due to wall size, for example).

While the various embodiments of this invention have been described in detail with particular reference to exemplary embodiments, those skilled in the art will understand that variations and modifications can be effected within the scope of the invention as defined in the appended claims. Accordingly, the scope of the various embodiments of the present invention should not be limited to the above discussed embodiments, and should only be defined by the following claims and all equivalents.

I claim:

1. A system to repair a wall, the system comprising:

a wall support member disposed proximate a wall;

a tension member, comprising only a first end and a second end, the first end coupled to the wall support member and the second end coupled to a portion of the wall below the wall support member to exert a downward force on the wall support member such that the wall support member tends to move down the wall;

an elongated brace having two ends with a first end being affixed to the wall support member and the second end being fixed at a point such that the brace directs a horizontal force toward the wall support member to move the wall; and a pivotal coupler to couple the first end of the brace and the wall support member so that the first end of the brace can pivot relative to the wall support member.

2. The system of claim 1, further comprising an anchor disposed below the wall support member, and connected to a portion of the wall, from below the wall, and below the wall support member and the tension member.

3. The system of claim 2, the anchor comprising an attachment portion so that the anchor can be affixed to a foundational pier associated with the wall.

4. The system of claim 1, further comprising a stake to hold the elongated brace at the fixed point, the brace being in operable communication with the second end of the brace to prevent horizontal movement of the second end of the brace.

5. The system of claim 1, the wall support member having a surface area ranging from approximately one square foot to approximately three square feet.

6. The system of claim 1, the tension member being at least one of a chain, nylon strap, screw, and tension rod.

7. The system of claim 1, further comprising a jack connected to the tension member adapted to decrease the length of the tension member to vary the downward force.

8. The system of claim 7, the jack connected to the brace to provide a force along the brace to direct a horizontal force toward the wall support member to move the wall.

9. The system of claim 1, wherein the brace has multiple telescoping members adapted to move relative to each other.

10. A method to repair a wall, the method comprising:

providing a wall support member proximate a wall to be in contact with the wall;

coupling an anchor to the wall from beneath the wall and below the wall support member;

coupling the anchor to the wall support member;

applying a substantially downward vertical force on the wall support member;

redirecting the vertical force to the wall support member such that the force is directed toward the wall in a substantially horizontal direction such that a horizontal force moves the wall; and pivotally coupling a brace to the wall support member at a first end of the brace and affixing a second end of the brace to a fixed point such that the fixed point causes the brace to direct the vertical force horizontally toward the wall.

11. The method of claim 10, further comprising affixing an anchor proximate a foundational pier, coupling the anchor to the wall support member, and causing the wall support member to move closer to the anchor such that the anchor exerts the substantially downward vertical force on the wall support member.

12. The method of claim 10, further comprising fixing the second end of the brace at the fixed point with a stake such that the stake fixes the brace to prevent the brace from moving in a horizontal direction away from the wall.

13. The method of claim 10, further comprising pivotally affixing the wall support member to the first end of the brace.

14. The method of claim 10, the wall support member having a surface area ranging from approximately one square foot to approximately three square feet.

15. In a system to repair a damaged wall by providing a horizontal force toward the wall, an apparatus configured to redirect a vertical force to provide the horizontal force, the apparatus comprising:

a wall support member disposed proximate a wall;

a force application brace having a first end and a second end, the first end being directed toward a damaged wall and the second end being fixed such that the second end can not move away from the damaged wall;

an anchor disposed below the first end of the brace and underneath the damaged wall; and a tension member, with a first end and a second end, the first end coupled to the wall support member and the second end coupled to, and terminating at, the anchor, configured to draw the first end of the brace closer to the anchor such that the distance between the first end of the brace and the anchor is decreased by application of a downward vertical force at the first end of the brace;

wherein the wall support member is disposed between and pivotally coupled to the first end of the brace and the damaged wall, the wall support member configured to distribute the horizontal force transferred to the wall; and wherein the second end of the force application brace receives the downward vertical force, provides the vertical force horizontally, and applies a horizontal force toward the wall.

16. The apparatus of claim 15, further comprising a crank device coupled between the tension member and the first end of the brace, the crank device being configured to reduce the length of the tension member.

17. The apparatus of claim 15, further comprising a jack associated with the force application brace such that the jack is configured to adjust the length of the force application brace to direct a horizontal force toward the wall.

* * * * *